US010465690B2

(12) United States Patent
Fullemann

(10) Patent No.: US 10,465,690 B2
(45) Date of Patent: Nov. 5, 2019

(54) METHOD FOR CONTROLLING A PUMP ARRANGEMENT

(71) Applicant: XYLEM IP MANAGEMENT S.À R.L., Senningerberg (LU)

(72) Inventor: Alexander Fullemann, Sollentuna (SE)

(73) Assignee: XYLEM EUROPE GMBH (CH)

( * ) Notice: Subject to any disclaimer, the term of this patent is extended or adjusted under 35 U.S.C. 154(b) by 241 days.

(21) Appl. No.: 15/315,418

(22) PCT Filed: Jun. 1, 2015

(86) PCT No.: PCT/IB2015/054145
§ 371 (c)(1),
(2) Date: Dec. 1, 2016

(87) PCT Pub. No.: WO2015/186046
PCT Pub. Date: Dec. 10, 2015

(65) Prior Publication Data

US 2017/0198698 A1 Jul. 13, 2017

(30) Foreign Application Priority Data

Jun. 3, 2014 (SE) ..... 1450673

(51) Int. Cl.
*F04D 15/00* (2006.01)
*F04D 29/70* (2006.01)
(Continued)

(52) U.S. Cl.
CPC ..... *F04D 15/0077* (2013.01); *F04D 13/06* (2013.01); *F04D 15/0066* (2013.01);
(Continued)

(58) Field of Classification Search
CPC ..... F04D 7/04; F04D 13/06; F04D 15/0066; F04D 15/0077; F04D 15/0245;
(Continued)

(56) References Cited

U.S. PATENT DOCUMENTS 2,762,004 A * 9/1956 Shepardson ..... H02H 7/0858 241/46.013
3,961,758 A * 6/1976 Morgan ..... B02C 18/0092 241/46.11
(Continued)

FOREIGN PATENT DOCUMENTS

JP 1193859 A 4/1999
JP H11-270463 A 10/1999
(Continued)

OTHER PUBLICATIONS

Notice of Reasons for Rejection for Japanese Application No. 2016-570978, dated Nov. 27, 2017 with translation, 9 pages.
(Continued)

*Primary Examiner* — Patrick Hamo
*Assistant Examiner* — Joseph S. Herrmann
(74) *Attorney, Agent, or Firm* — RatnerPrestia

(57) ABSTRACT

A method for controlling a pump arrangement upon clogging. The arrangement includes a pump and a control unit. The pump includes a motor, and the control unit drives the motor. The motor during operation is associated with an operational parameter from which the motor torque may be derived. The operational parameter has a normal value $P_N$ during normal operation of the motor in a first direction. The method includes the steps of driving the motor in a first direction by the control unit, stopping the motor if a real value P of the operational parameter exceeds a predetermined clogging limit $P_I$, driving the motor in an opposite second direction a predetermined flushing time $T_R$ by the control unit, and stopping the motor if the absolute value of the real value P of the operational parameter during the flushing time $T_R$ exceeds the absolute value of a first unfastening limit $P_{L1}$.

10 Claims, 7 Drawing Sheets

(51) Int. Cl.
*F04D 13/06* (2006.01)
*F04D 15/02* (2006.01)
*F04D 7/04* (2006.01)

(52) U.S. Cl.
CPC ..... *F04D 15/0254* (2013.01); *F04D 29/708* (2013.01); *F04D 7/04* (2013.01)

(58) Field of Classification Search
CPC .. F04D 29/708; F04D 15/0254; F04B 23/021; F04B 49/022; F04B 49/02
USPC ..... 318/445, 452, 455
See application file for complete search history.

(56) References Cited

U.S. PATENT DOCUMENTS 5,356,266 A * 10/1994 Jensen ..... F04D 13/06 318/778
6,379,109 B1 * 4/2002 Senior, Jr. ..... B01F 3/04773 210/219
6,481,973 B1 * 11/2002 Struthers ..... F04D 7/045 417/36
6,854,673 B2 * 2/2005 Strutz ..... B02C 18/24 241/33
7,448,563 B2 * 11/2008 Berger ..... B02C 18/16 241/30
8,784,038 B2 * 7/2014 Ciotola ..... B02C 18/0092 241/21
9,735,713 B2 * 8/2017 Ek ..... G05B 19/0428
2005/0123408 A1 6/2005 Koehl
2009/0081050 A1 3/2009 Moore et al.
2013/0323084 A1 12/2013 McIvor

FOREIGN PATENT DOCUMENTS

JP 2005030322 A 2/2005
JP 2006-029222 A 2/2006
JP 2008-202553 A 9/2008
JP 05-007577 B2 8/2012
SE 1151254 A1 6/2013
WO WO 2013/096726 A1 6/2013

OTHER PUBLICATIONS

PCT International-Type Search Report, dated Jan. 29, 2015, corresponding to Swedish Patent Application No. 1450673-7, filed Jun. 3, 2014.
International Search Report for International Application No. PCT/IB2015/054145 dated Aug. 3, 2015.
Written Opinion of the International Searching Authority for International Application No. PCT/IB2015/054145 dated Aug. 3, 2015.

* cited by examiner

METHOD FOR CONTROLLING A PUMP ARRANGEMENT

CROSS-REFERENCE TO RELATED APPLICATIONS

This patent application is a U.S. National Phase Patent Application of PCT Application No. PCT/IB2015/054145, filed Jun. 1, 2015, which claims priority to Swedish Patent Application No. 1450673-7, filed Jun. 3, 2014, both of which are incorporated by reference herein in their entirety.

TECHNICAL FIELD OF THE INVENTION

The present invention relates in general to a method for controlling a pump arrangement comprising a pump and a control unit, the pump comprising a motor, and the control unit being arranged to drive said motor. Especially the present invention relates to a method for controlling a pump arrangement, the motor during operation being associated with an operational parameter from which the torque of the motor may be derived, said operational parameter has a normal value $P_N$ during normal operation of the motor in a first direction,

BACKGROUND OF THE INVENTION AND PRIOR ART

Upon pumping of a liquid, such as waste water comprising solid matter, by means of for instance a submersible pump, the solid matter will sooner or later have a negative influence on the capacity of the pump to transport the liquid. The solid matter stick fast in the hydraulic unit of the pump and attach slowly to the impeller of the pump as well as to the inner side of the pump house of the pump, and thereby the hydraulic efficiency of the pump is effected negatively and the pump will operate in a strained operation condition due to the increased rotary resistance, increased torque and deteriorated hydraulic properties. Today several known ways of more or less automatic cleaning of a pump when the pump, or more precisely the hydraulic unit of the pump, starts to clog. The strained operation condition is not directly detrimental for the pump, however an increased power consumption and worse pump performance is obtained, which is costly for the plant owner and which may result in negatively attendant effects such as flooded pump station when the accessible capacity of the pump is not enough to empty the pump station.

Known cleaning methods, or methods for controlling a pump arrangement, detects that cleaning is necessary and thereafter perform a predetermined standard cleaning sequence, that at least entail that the motor of the pump is decelerated by having the speed of the motor undergo a long predetermined ramping down driven by the control unit. It is known that one shall not stop the motor of the pump directly, especially due to requirements of avoiding so-called water hammer in the pipe system downstream the pump, but also due to the high torque and the big momentum that the impeller of the pump have during normal operation. If the motor is stopped directly water hammering will inevitable arise when the kinetic energy and the moment of inertia of the liquid in the pipes downstream the pump cause vibrations that risk to destroy the pipes and other construction elements, thereto it is an imminent risk that the impeller is loosen, the drive shaft of the pump is damaged, etc. Thus, a long and controlled ramping down of the speed of the motor always takes place.

A direct consequence of the absence of intelligence in the cleaning method is that the standard cleaning sequence used, and which is adequate during a strained operation condition as described above, drastically increase the load of the pump when a large and/or hard object enters the hydraulic unit of the pump and is wedged, i.e. when a detrimental operation condition for the pump arrangement has arisen. A detrimental operation condition mean an operation condition that immediately or in a short period of time will entail that the pump and/or the control unit will break. When the control unit, for instance in the form of a frequency converter (VFD), perform said ramping down when a large and/or hard object has become wedged and mechanically brake the impeller, the long and controlled ramping down of the motor force the impeller to rotate and the object is wedged harder/more severe. This entail in its turn that the impeller, drive shaft motor, etc. of the pump or the control unit will become overstrained and damaged.

In order to prevent the pump and/or the control unit to become damaged different safety systems/protective equipment, such as a safety disconnection breaker, fuses, etc., which are arranged to protect the equipment and trig before the equipment is damaged. Common for the above described detrimental operation conditions, i.e. if the safety system triggers and/or the pump arrangement break, service personal must perform an emergency turnout and take care of the fault/clogging. These turnouts are expensive and thereto an idle pump is costly for the plant owner.

BRIEF DESCRIPTION OF THE OBJECT OF THE INVENTION

The present invention aims at obviating the above mentioned drawbacks and failings of previously known cleaning methods and at providing an improved method for controlling a pump arrangement. A basic object of the invention is to provide an improved method for controlling a pump arrangement according to the initially defined type, which prominently will increase the number of clogging that the pump arrangement will solve by its own.

Another object of the present invention is to provide a method for controlling a pump arrangement, which pretty perfect prevent the need for service personnel to perform emergency turnouts.

BRIEF DESCRIPTION OF THE FEATURES OF THE INVENTION

According to the invention at least the basic object of the invention will be achieved by the initially defined method having the features defined by the independent claims. Preferable embodiments of the present invention are further defined in the dependent claims.

According to the present invention it is provided a method for controlling a pump arrangement of the initially defined type, which is characterized by the steps of:

- driving the motor in a first direction by means of the control unit,
- stopping the motor if a real value P of the operational parameter exceed a predetermined clogging limit $P_I$, where $P_I \geq 1.05 * P_N$,
- driving the motor in a the first direction opposite second direction a predetermined flushing time $T_R$ by means of the control unit, and
- stopping the motor if the absolute value of the real value P of the operational parameter during the flushing time $T_R$ exceed the absolute value of a first unfastening limit $P_{L1}$, where $|P_{L1}| \geq 1.1 * P_I$, otherwise stopping the motor after said flushing time $T_R$ and returning to normal operation.

Thus, the present invention is based on the understanding that by stopping the driving of the motor in the first direction at a lower torque than the torque at which the driving of the motor in the second direction is stopped, i.e. to have a greater torque available for unfastening of the wedged material than the torque that wedged the material, the pump arrangement is spared and the number of emergency turnouts will be more or less entirely eliminated.

According to a preferred embodiment of the present invention, the method after the step of stopping the motor if a real value P of the operational parameter exceed a predetermined clogging limit $P_I$, where $P_I \geq 1.05 * P_N$, thereto comprises the steps of:

driving the motor in the first direction during a predetermined control time $T_K$ by means of the control unit, stopping the motor if the real value P of the operational parameter during the control time $T_K$ exceed a false alarm control limit $P_F$, where $P_F \leq P_I$.

Thereby a false alarm function is achieved whereupon unnecessary operation of the pump backwards may be avoided.

According to a preferred embodiment of the present invention, the method after the step of stopping the motor if the absolute value of the real value P of the operational parameter exceed the absolute value of a first unfastening limit $P_{L1}$, where $|P_{L1}| \geq 1.1 * P_I$, thereto comprises the steps of:

driving the motor in the first direction during a predetermined flushing time $T_R$ by means of the control unit, stopping the motor if the real value P of the operational parameter exceed a second unfastening limit $P_{L2}$, where $P_{L2} \geq PI$ and $P_{L2} \leq 0.95 * |P_{L1}|$.

Thereby the pump arrangement tries, when it has failed in the first unfastening attempt backwards, to unfasten the wedged material by means of an unfastening attempt forwards using an available torque that is greater than the available torque during normal operation forwards but less than the available torque during unfastening backwards.

According to a preferred embodiment of the present invention, the operational parameter is constituted by the power consumption of the motor.

Other advantages and features of the invention are evident from the other dependent claims and from the following detailed description of preferred embodiments.

BRIEF DESCRIPTION OF THE DRAWINGS

A more complete understanding of the above mentioned and other features of the present invention will be evident from the following detailed description of preferred embodiments having reference to the appended drawings, in which.

DETAILED DESCRIPTION OF PREFERRED EMBODIMENTS

Figure 1:
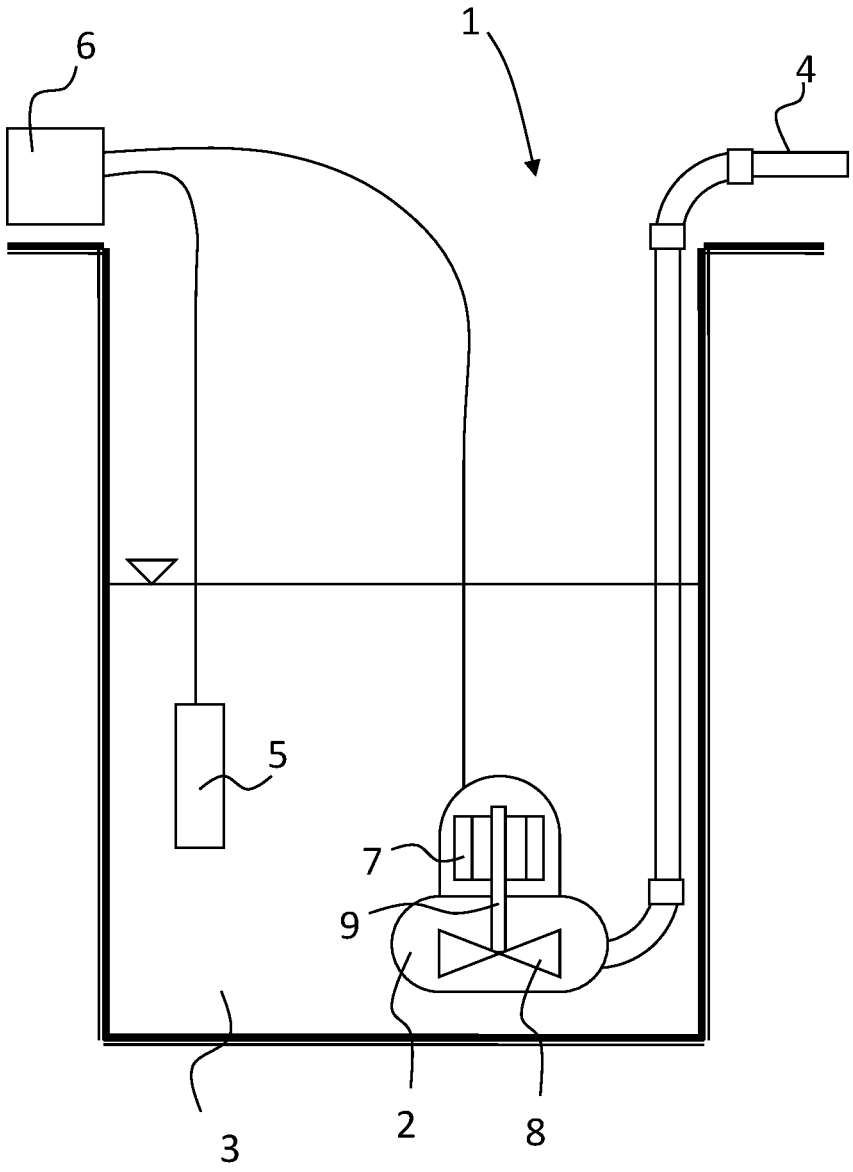
FIG. 1 is a schematic illustration of a pump station comprising a pump arrangement.

In FIG. 1 is shown a pump station, generally designated 1, comprising at least one speed controlled pump 2, usually two submersible pumps, arranged in an active state to pump liquid from a sump 3 comprised in the pump station 1 to a outlet pipe 4 and further away from the pump station 1. Thereto the pump station 1 comprises in a conventional way at least one level sensor 5 arranged to determine the liquid level in the pump station 1. It shall be pointed out that the level sensor 5 may be a separate device that is operatively connected to an external control unit 6, operatively connected to said at least one speed controlled pump 2, be built-in in said at least one speed controlled pump 2, etc. Said at least one speed controlled pump 2 is preferably operatively connected to the external control unit 6 in order to admit control of the speed of the pump, alternatively said at least one speed controlled pump 2 may comprise a built-in control unit (not shown). Hereinbelow the term control unit 6 will be used independently of its physical location.

The pump 2 and the control unit 6 together constitute at least a part of the pump arrangement, in which the pump 2 comprises an electrical motor 7 that is arranged to be driven by said control unit 6, and an impeller 8 that is connected with the motor 7 via a drive shaft 9 in a conventional way. Preferably the impeller 8 is an open impeller, and most preferably an impeller that is axially displaceable in the pump 2, in relation to a suction lid/insert ring at the inlet of the pump, during operation.

By the term "speed controlled" all conceivable ways of altering the speed of the pump, or more precisely the rotational speed/operational speed of the motor 7, are covered. Above all current supply frequency control by means of a frequency converter (Variable Frequency Drive) is concerned, which is built-in in a pump or external, and which constitute an example on said control unit 6, the rotational speed being proportional to the current supply frequency during normal operation. However, also internally or externally controlled voltage supply control is concerned. Thus, on an overall level of the invention, it is not essential how the operational speed of the pump is controlled, just that the rotational speed of the pump 2 may be controlled/adjusted.

The inventive method is directed to control a pump arrangement comprising a pump 2 having a motor 7 and a control unit 6 arranged to control said motor 7, in order to achieve an efficient cleaning of the pump upon clogging. The pump station 1 shall in this context be seen as a delimited plant to which incoming liquid arrive and from which outgoing liquid is pumped. The pump station shall, as regards the present invention, be regarded independently of the type of liquid and independently of wherefrom the liquid originates and whereto the liquid is pumped. In the case the pump station comprises several pumps 2 suitable alterations between them may take place, however this is not described further by the present application.

Thereto the pump 2 is started and stopped during normal operation in accordance with known methods and is not described herein.

Figure 2:
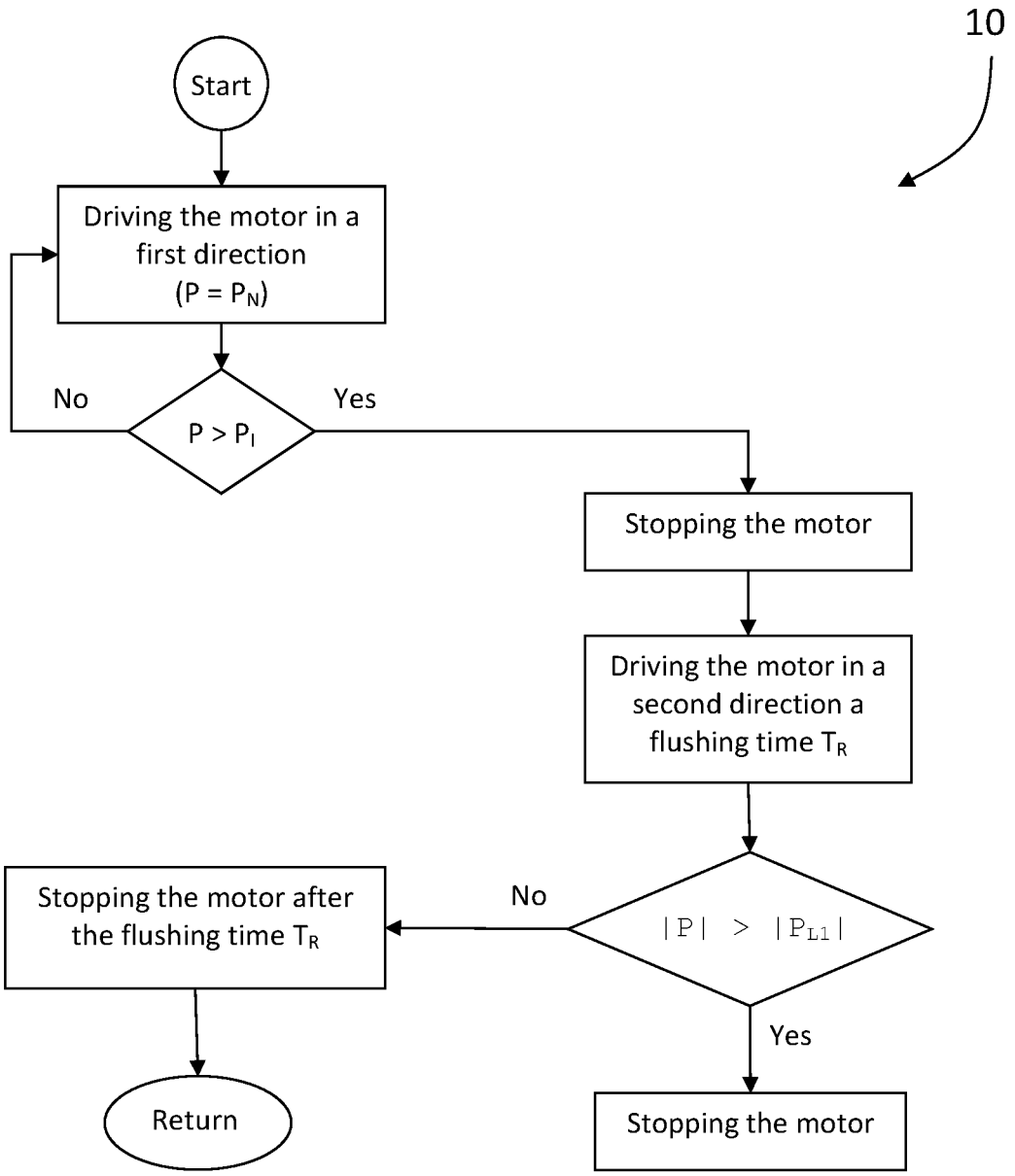
FIG. 2 is a flowchart disclosing a first embodiment of the inventive method.

In FIG. 2 is shown a predetermined embodiment of a method, generally designated 10, for control of a pump arrangement comprising a pump 2 and a control unit 6. It shall be pointed out that the inventive method 10 may be expanded with one or more sub methods, and/or be driven in parallel/sequentially with other control methods.

The inventive method 10 for control of a pump arrangement is in practice a cleaning method for a pump that is entirely or partly clogged, i.e. a foreign material has entered the pump 2 and wedged the impeller 8.

The degree of clogging and/or the type of clogging cause a load on the motor 7 of the pump 2 and indicate an operational condition of the pump arrangement. Thus the motor 7 at each individual point of time, when the pump 2 is in an active state and the motor 7 is driven in a first direction by the control unit 6, is associated with a load level that corresponds to an operational condition of the pump arrangement. The pump arrangement also comprises means for, intermittently of continuously, monitoring at least one operational parameter from which the torque of the motor 7 may be derived, either by direct measurement or by being derived from the measurement of another operational parameter/quantity. Said operational parameter P is preferably constituted by current consumption or torque, but also other operational parameters such as power consumption are conceivable. In reality the load level of the motor 7 will change, thereby changing the torque and the operational/rotational speed, when the hydraulic unit of the pump 2 is entirely or partly clogged. A direct effect of this is that the current consumption, power consumption, etc. of the pump is changed correspondingly, whereby the torque of the motor 7 may be derived from for instance the current consumption of the motor. Preferably the real current consumption of the pump 2, or more precisely of the motor 7, is monitored when the pump 2 is in the above mentioned active state, and hereinbelow the invention will be described having this as a basis. However, it shall be realized that the invention is not delimited to the measurement of the current consumption as the operational parameter Said operational parameter has a normal value $P_N$ during normal operation of the motor 7 in a first direction. By the first direction is meant that the impeller 8 is driven forwards, i.e. pumps liquid out via the outlet pipe 4.

Now the inventive method 10 will be described in its most basic form with reference to FIG. 2.

The method 10 start out from that the pump 2 is in its active state and the motor 7 is driven in a first direction by the control unit 6. In this connection and during normal operation said first direction the direction resulting in liquid being transported by the impeller 8 from the sump 3 via the outlet pipe 4, i.e. the motor 7 is drive in the forward direction. Upon start of the pump 2, i.e. starting from an inactive state of the pump 2, the control unit 6 perform a controlled, for instance linear, ramping up of the real operational/rotational speed F of the motor 7 from 0 to an operational speed $F_N$ to be used during normal operation, that for instance constitute about 75-85% of the so-called maximum rotational speed $F_{MAX}$ of the motor 7. The maximum rotational speed of the motor 7 is the rotational speed that the motor 7 has of the pump 2 should be directly connected to the power mains (i.e. usually a current supply frequency of 50 Hz or 60 Hz). The normal operational speed $F_N$ may for instance be a constant value or a value changing over time, may for instance be a manually set value or an automatically optimized value based on the momentary energy consumption, etc. This also entail that the normal value $P_N$ of the operational parameter may be constant or changing over time in line with present status of the normal operational speed $F_N$. It shall also be pointed out that different nature of the pumped liquid entail different load on the pump 2 at unchanged normal operational speed $F_N$, which entails that the normal value PN of the operational parameter is also dependent on the load on the pump 2 in the specific application, i.e. different pump stations receives liquid having different characteristics. Thereto the liquid entering one and the same pump station may present different characteristics during different hours of the day.

When the pump 2 is in said active state a real value P of said at least one operational parameter is determined/monitored, and in the described embodiment the real current consumption is determined. The real current/power consumption vary during normal operation about a nominal value of the current consumption due to the fact that solid matter found in the pumped liquid enters, has influence on and is transported through the hydraulic unit of the pump 2 and thereby has a momentary influence on the load level/torque of the motor 7.

During monitoring of said real value P of said at least one operational parameter it can be determined if an externally applied force acts against the motor 7 in such an extent that a detrimental operational condition of the pump arrangement is initiated, which is true if the load level/torque of the motor 7 exceed a detrimental level for the pump arrangement. By detrimental operational condition is meant an operational condition that immediately or within a short time will result in the pump 2 and/or the control unit 6 will become overworked and break if unchanged operation of the motor 7, alternatively safety systems/protective equipment will trigger. A detrimental operational condition is present if a large and/or hard object enters the hydraulic unit of the pump 2 and is wedged between the impeller 8 and the pump housing or the suction lid/insert ring.

The method 10, when the motor 7 is driven in the first direction, comprises the step of determining if the real value P of the operational parameter exceed a predetermined clogging limit $P_I$, where $P_I$ is greater than or equal to a factor 1.05 times the normal value $P_N$ of the operational parameter. If $P>P_I$ the motor 7 is stopped otherwise continue normal operation. Preferably the relationship between the operational parameter $P_I$ and the normal value $P_N$ of the operational parameter is: $P_I \geq 1.1*P_N$, and most preferably $P_I \geq 1.2*P_N$.

It shall be pointed out that due to the fact that the normal value $P_N$ of the operational parameter may vary during operation also the clogging limit $P_I$ of the operational parameter will vary, however the above given mutual relationship between them remains.

By the expression stopping the motor is meant to perform a change of state from the active state of the pump to an inactive state of the pump 2. The step of stopping the motor 7 preferably include in this connection that the control unit 6 immediately after the determination of the clogging directly break the drive of the motor 7 in the first direction. The feature of directly breaking the drive, is realized by having the operational speed $F_N$ of the motor 7 set equal to zero in the control unit 6, i.e. no ramping down of the rotational speed of the motor 7 takes place, or by having the operational speed $F_N$ of the motor 7 set equal to zero by disengaging the motor 7, i.e. the motor 7 is made completely dead. This entail that the foreign object that entered and wedged the hydraulic unit of the pump 2, is not wedged harder/more severe.

After a clogging is detected and the motor 7 is stopped, the method 10 starts a cleaning sequence. After the step that the motor 7 is stopped a step of driving the motor 7 in a the first direction opposite second direction a predetermined flushing time $T_R$ by means of the control unit 6 is performed. The term driving the motor 7 in a second direction is meant that the motor 7 is driven in the backwards direction. During the flushing time TR the pump arrangement tries to flush the object that has become wedged back into the sump 3.

During the flushing time TR and the driving of the motor 7 in the second direction, the control unit 6 tries to generate a cleaning speed backwards $F_{RB}$ of the motor 7. The absolute value of the cleaning speed backwards $F_{RB}$ is preferably in the range 75-85% of the maximum rotational speed F of the motor 7. During the flushing time $T_R$ the method performs the step of determining if the absolute value of the real value P of the operational parameter exceed the absolute value of the first unfastening limit $P_{L1}$, where the absolute value of the first unfastening limit $P_{L1}$ of the operational parameter is greater than or equal to a factor 1.1 times the clogging limit $P_I$ of the operational parameter. If $|P|>|P_{L1}|$ stopping the motor 7, which means that the material that has been wedged does not come loose and is not flushed out in the first unfastening attempt backwards. If $|P|<|P_{L1}|$ stopping the motor 7 after said flushing time $T_R$ and then returning to normal operation, which means that the material that has become wedged is flushed back into the sump 3 during the first unfastening attempt backwards. Preferably the relationship between the first unfastening limit $P_{L1}$ of the operational parameter and the clogging limit $P_I$ of the operational parameter is: $|P_{L1}|\geq 2*P_I$, and most preferably $|P_{L1}|\geq 3*P_I$.

After the step that the motor 7 is stopped after it is determined that the real value P of the operational parameter exceed the clogging limit $P_I$, the method preferably comprises also the step of detaining the pump 2 in the inactive state a predetermined waiting time $T_V$. In other words the pump 2 is kept inactive a waiting time $T_V$ before the first unfastening attempt backwards is initiated, or before a false alarm control that will be described hereinbelow.

After the step that the motor 7 is stopped after the flushing time $T_R$, the method preferably comprises also the step of detaining the pump 2 in the inactive state a predetermined waiting time $T_V$. In other words the pump 2 is kept inactive a waiting time $T_V$ before normal operation is resumed.

Figure 3:
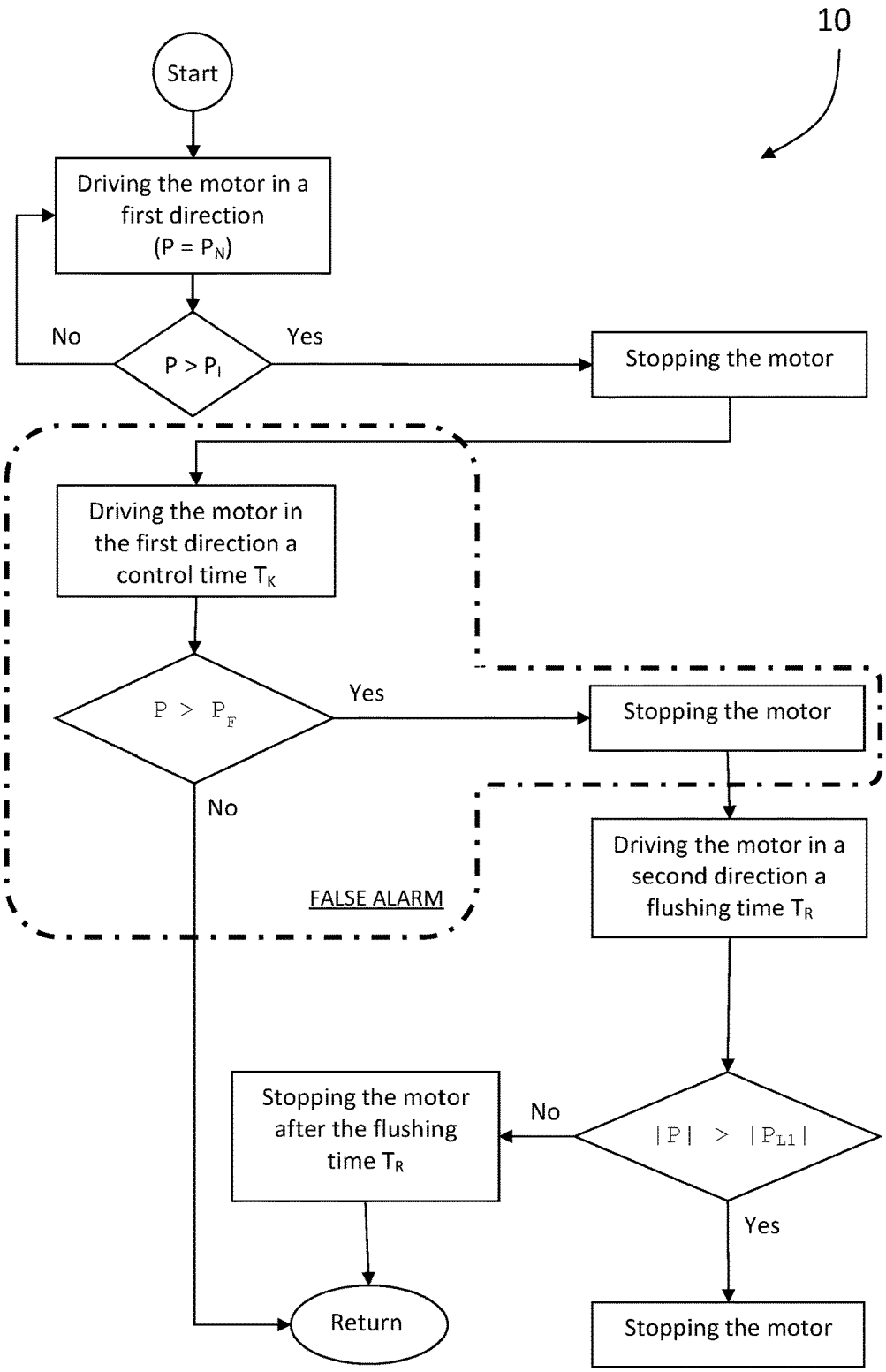
FIG. 3 is a flowchart disclosing a second embodiment of the inventive method.

Reference is now made to FIG. 3, in which an addition to the method according to FIG. 2 in the form of a false alarm control is described, other parts of the method 10 remains unamended and are not described hereinbelow.

After the step that the motor 7 is stopped after it is determined that the real value P of the operational parameter exceed the clogging limit $P_I$, the method comprises the step of driving the motor 7 in the first direction during a predetermined control time $T_K$ by means of the control unit 6. During the control time $T_K$ the method perform the step of determining if the real value P of the operational parameter exceed a false alarm control limit $P_F$, where the false alarm control limit $P_F$ of the operational parameter is less than or equal to the clogging limit $P_I$ of the operational parameter. The false alarm control is performed one or several times. If $P>P_F$ stopping the motor 7, which means that it is not a false alarm but the clogging is confirmed. During the false alarm control the material that has caused the clogging stop of the motor 7 is sometimes flushed out via the outlet pipe 4. Preferably the relationship between the false alarm control limit $P_F$ of the operational parameter and the normal value $P_N$ of the operational parameter is: $P_F\geq P_N$. During the control time $T_K$ and during the driving of the motor 7 in the first direction, the control unit 6 tries to generate a false alarm speed $F_F$ of the motor 7 that preferably is equal to the normal operational speed $F_N$.

After the control time $T_K$ the control unit 6 may continue to drive the motor 7 in the first direction according to normal operation, alternatively the motor 7 may be stopped and the pump 2 is detained in the inactive state a predetermined waiting time $T_V$ before normal operation is resumed.

After the step that the motor 7 is stopped after it is determined that the real value P of the operational parameter exceed the false alarm control limit $P_F$, the method preferably comprises also the step of detaining the pump 2 in the inactive state a predetermined waiting time $T_V$. In other words the pump 2 is kept inactive a waiting time $T_V$ before the first unfastening attempt backwards in initiated.

Figure 4:
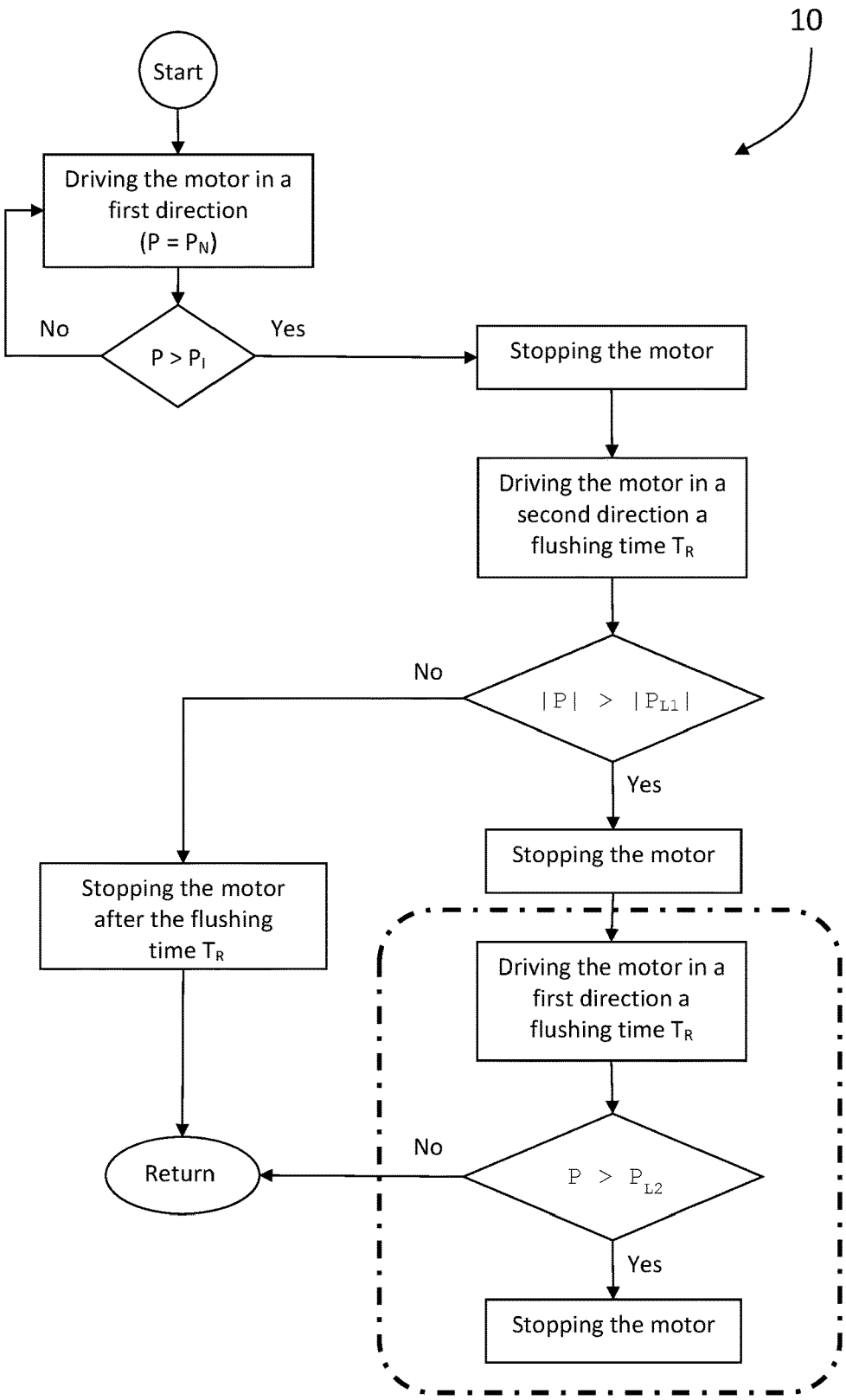
FIG. 4 is a flowchart disclosing a third embodiment of the inventive method.

Reference is now made to FIG. 4 in which an addition to the method according to FIG. 2 in the form of an unfastening attempt forward is described, the other parts of the method 10 remains unamended and are not described hereinbelow.

After the step that the motor 7 is stopped after it is determined that the absolute value of real value P of the operational parameter exceed the absolute value of the first unfastening limit $P_{L1}$, the method comprises the step of driving the motor 7 in the first direction during a predetermined flushing time $T_R$ by means of the control unit 6. During the flushing time $T_R$ and the driving of the motor 7 in the first direction, the control unit 6 tries to generate a cleaning speed forward $F_{RF}$ of the motor 7.

The cleaning speed forward $F_{RF}$ is preferably in the range 75-100% of the maximum rotational speed F of the motor 7. During the flushing time $T_R$ the method perform the step of determining if the real value P of the operational parameter exceed a second unfastening limit $P_{L2}$, where the second unfastening limit $P_{L2}$ is greater than or equal to the clogging limit $P_I$ of the operational parameter and is less than or equal to a factor 0.95 times the absolute value of the first unfastening limit $P_{L1}$. If $P>P_{L2}$ stopping the motor 7, which means that the material that has become wedged does not come loose and is not flushed out during the first unfastening attempt forwards. If $P<P_{L2}$ and after the flushing time TR the control unit 6 may continue to drive the motor 7 in the first direction according to normal operation, alternatively the motor 7 may be stopped and the pump 2 being detained in the inactive state a predetermined waiting time $T_V$ before normal operation is resumed. $P<P_{L2}$ entail that the material that has become wedged is flushed out via the outlet pipe 4 during the first unfastening attempt forwards. Preferably the relationship between the first unfastening limit $P_{L1}$ of the operational parameter and the second unfastening limit $P_{L2}$ of the operational parameter is: $P_{L2}\leq 0.85*|P_{L1}|$, and most preferably $P_{L2}=0.8*|P_{L1}|$.

It shall be pointed out that after the first unfastening attempt backwards yet one or more unfastening attempts backwards may be performed before the first unfastening attempt forwards is performed. Thereto the method 10 may perform several alternations between unfastening attempts backwards and unfastening attempts forwards before service personnel is called to the plant, wherein each unfastening attempt backwards may comprise one or more unfastening attempts and wherein each unfastening attempt forwards may comprise one or more unfastening attempts. For instance the first unfastening limit $P_{L1}$ may increase after each failed unfastening attempt, and for instance the second unfastening limit $P_{L2}$ may increase after each failed unfastening attempt.

The method 10 may also, when the wedged material has become free and before normal operation is resumed, comprise a flushing of the pump 2 by driving the motor 7 in the first direction at the maximum rotational speed F during a flushing time $T_R$ by means of the control unit 6.

Figure 5:
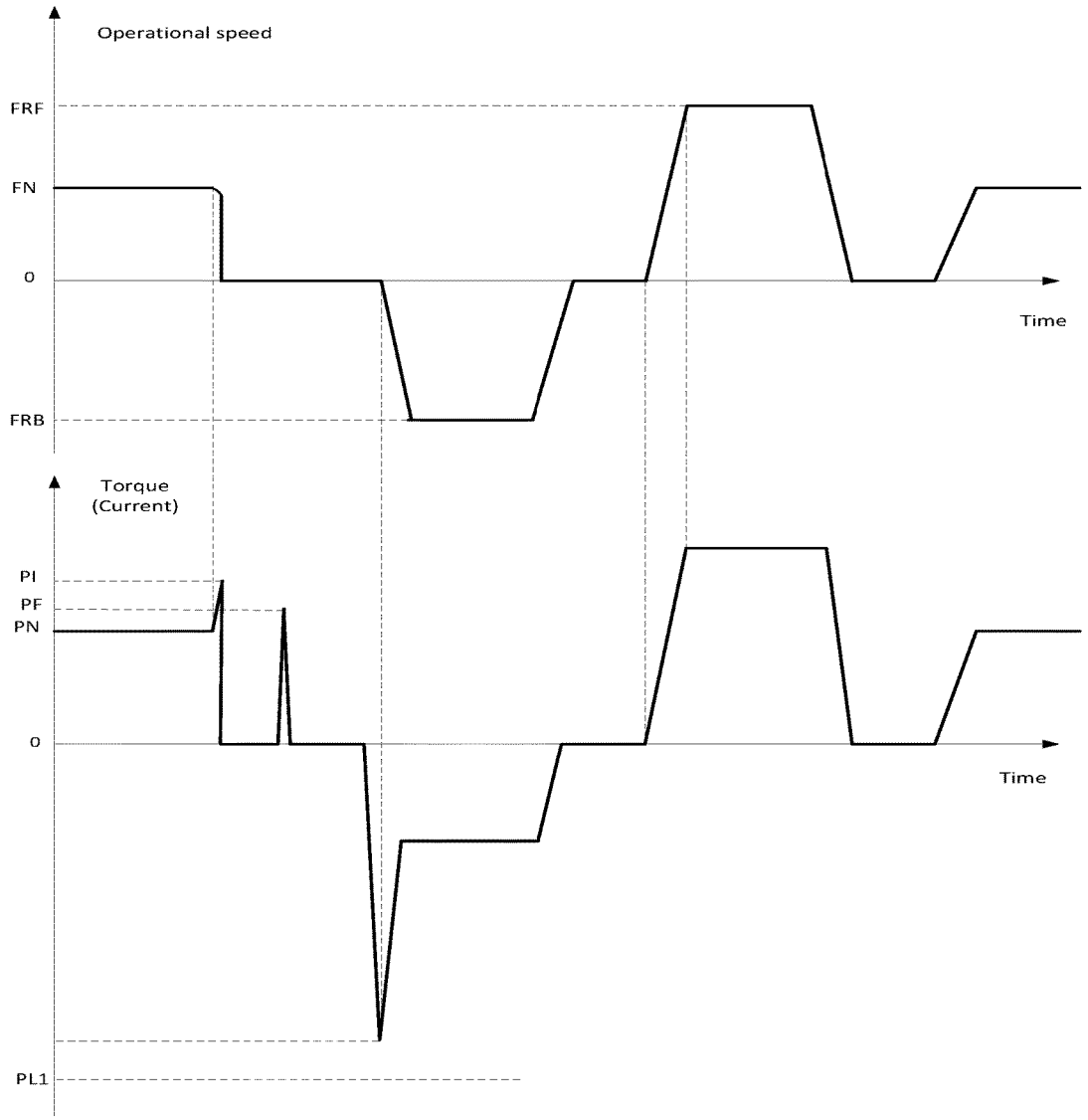
FIG. 5 is a diagram that schematically disclose how the power consumption of the pump is altered over time, during a successful cleaning/unfastening in the second direction.
Figure 6:
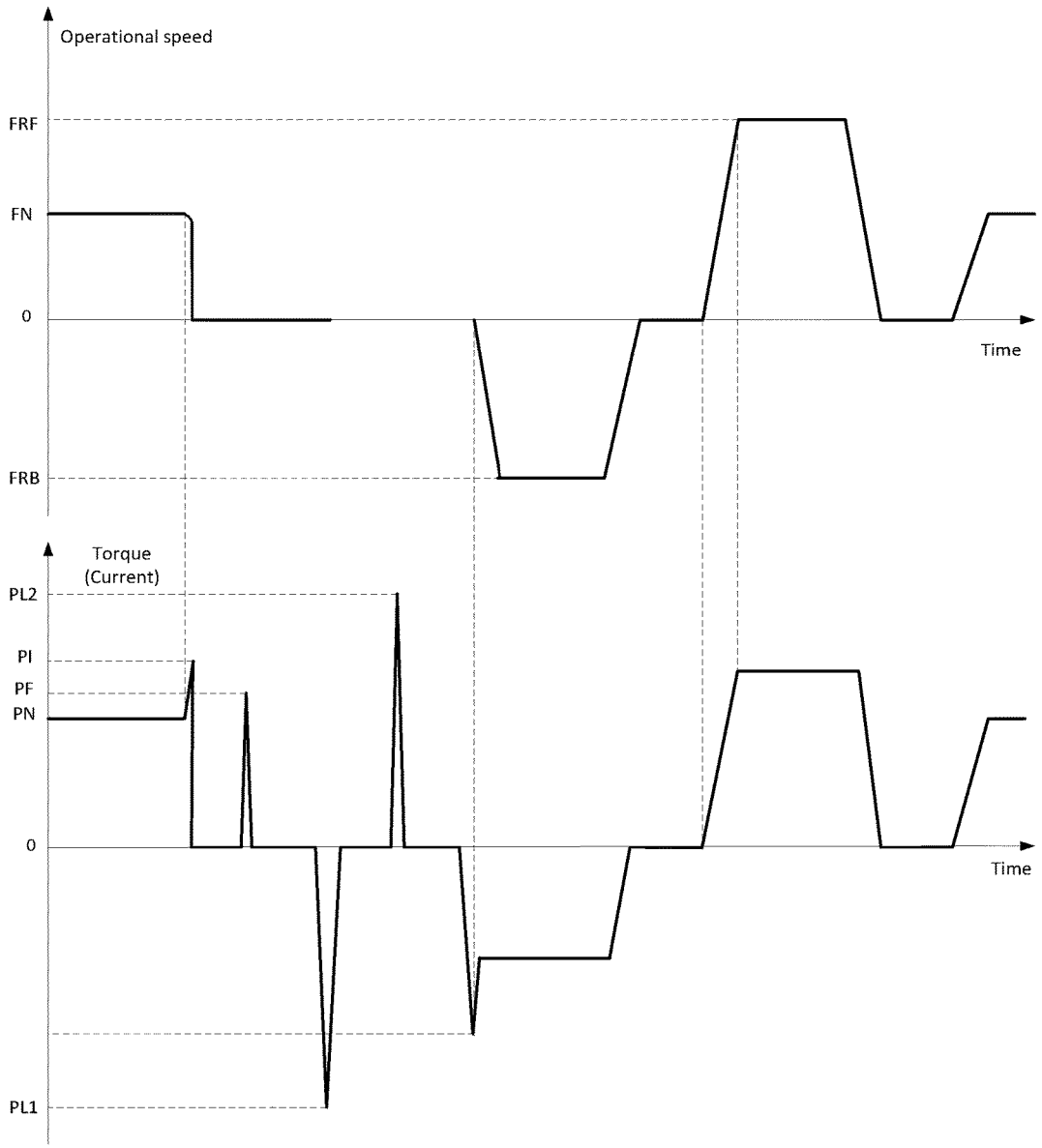
FIG. 6 is a diagram that schematically disclose how the power consumption of the pump is altered over time, during a successful unfastening in the second direction after several unsuccessful unfastening attempts.
Figure 7:
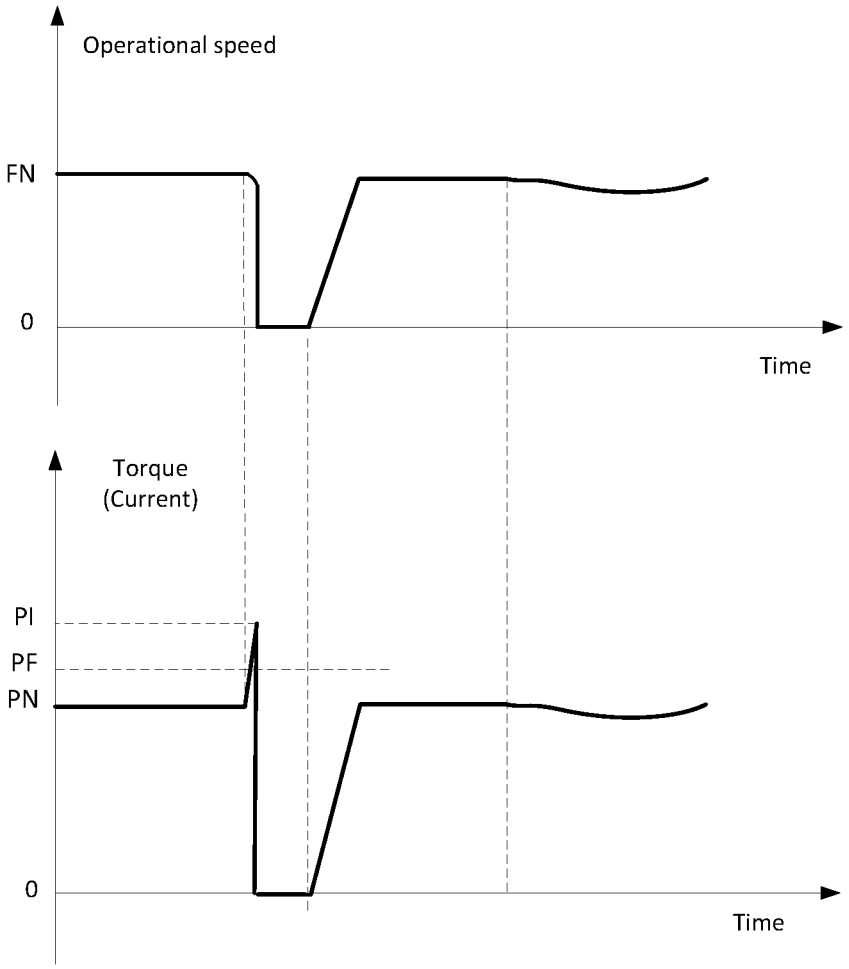
FIG. 7 is a diagram that schematically discloses how the power consumption of the pump is altered over time, during a false clogging.

Reference is finally made to FIGS. 5-7, which schematically disclose different cleaning sequences by means of an upper graph that disclose the real operational/rotational speed of the pump/motor and how this is changed over time, and a lower graph that disclose the real torque/current consumption of the pump/motor and how this is changed over time.

In FIG. 5 a clogging is detected whereupon a false alarm control is performed confirming the clogging. Thereafter a first unfastening attempt backwards is performed, which is successful. Thereafter a forward flushing is performed, having an optional subsequent waiting time during which the pump is inactive, before normal operation is resumed.

In FIG. 6 a clogging is detected whereupon a false alarm control is performed confirming the clogging. Thereafter a first unfastening attempt backwards is performed, which in unsuccessful. A first unfastening attempt forwards, which is unsuccessful. A second unfastening attempt backwards, which is successful. Thereafter a forward flushing is performed, having an optional subsequent waiting time during which the pump is inactive, before normal operation is resumed.

In FIG. 7 a clogging is detected whereupon a false alarm control is performed confirming the false alarm and normal operation is resumed.

Feasible Modifications of the Invention

The invention is not limited only to the embodiments described above and shown in the drawings, which primarily have an illustrative and exemplifying purpose. This patent application is intended to cover all adjustments and variants of the preferred embodiments described herein, thus the present invention is defined by the wording of the appended claims and thus, the equipment may be modified in all kinds of ways within the scope of the appended claims.

It shall be pointed out that even thus it is not explicitly stated that features from a specific embodiment may be combined with features from another embodiment, the combination shall be considered obvious, if the combination is possible.

It shall be realized that the waiting time $T_V$ may have different lengths during different phases of the method, however, one and the same reference is used in the description as well as in the claims for sake of clarity. The waiting time $T_V$ is in the range three seconds.

It shall be realized that the flushing time $T_R$ may have different lengths during different phases of the method, however, one and the same reference is used in the description as well as in the claims for sake of clarity. The flushing time $T_{VR}$ is in the range three seconds.

Exact values for the limits mentioned in this document are dependent on the specific pump arrangement and its surroundings during operation and are thus not mentioned, instead the mutual relationships between the mentioned limits are the essential in this document.

Throughout this specification and the appended claims, unless the context requires otherwise, it shall be realized that the word "comprise", and variations such as "comprises" or "comprising", will be understood to imply the inclusion of a stated integer or steps or group of integers or steps but not the exclusion of any other integer or step or group of integers or steps.

The invention claimed is:

1. A method for controlling a pump arrangement upon clogging of a pump, the pump arrangement comprising the pump and a control unit, the pump comprising a motor, and the control unit being arranged to drive said motor, the motor during operation thereof being associated with an operational parameter from which the torque of the motor may be derived, said operational parameter has a normal value $P_N$ during normal operation of the motor in a first direction, the method comprising:

driving the motor in the first direction using the control unit, stopping the motor as soon as a real value P of the operational parameter exceeds a predetermined clogging limit $P_I$, where $P_I \geq 1.05*P_N$, driving the motor in a second direction opposite the first direction for a predetermined flushing time $T_R$ using the control unit (6), and the control unit stopping the motor as soon as the absolute value of the real value P of the operational parameter during the flushing time $T_R$ exceeds an absolute value of a first unfastening limit $P_{L1}$, where $|P_{L1}| \geq 1.1*P_I$.

2. The method according to claim 1, wherein a relationship between the clogging limit $P_I$ of the operational parameter and the normal value $P_N$ of the operational parameter is: $P_I \geq 1.1*P_N$.

3. The method according to claim 1, wherein a relationship between the first unfastening limit $P_{L1}$ of the operational parameter and the clogging limit $P_I$ of the operational parameter is: $|P_{L1}|2*P_I$.

4. The method according to claim 1, wherein after the step of stopping the motor as soon as the real value P of the operational parameter exceeds the predetermined clogging limit $P_I$, where $P_I \geq 1.05*P_N$, the method comprises the step of maintaining the pump in an inactive state a predetermined waiting time $T_V$.

5. The method according to claim 1, wherein after the step of stopping the motor as soon as the real value P of the operational parameter exceeds the predetermined clogging limit $P_I$, where $P_I \geq 1.05*P_N$, the method comprises the steps of:

driving the motor in the first direction during a predetermined control time $T_K$ using the control unit, and stopping the motor as soon as the real value P of the operational parameter during the control time $T_K$ exceeds a false alarm control limit $P_F$, where $P_F \leq P_I$.

6. The method according to claim 5, wherein the relationship between the false alarm control limit $P_F$ of the operational parameter and the normal value $P_N$ of the operational parameter is: $P_F \geq P_N$.

7. The method according to claim 1, wherein after the step of stopping the motor as soon as the absolute value of the real value P of the operational parameter exceeds the absolute value of the first unfastening limit $P_{L1}$, where $|P_{L1} \geq 1.1*P_I$, the method comprises the steps of:

driving the motor in the first direction during a predetermined flushing time $T_R$ using the control unit, and stopping the motor as soon as the real value P of the operational parameter exceeds a second unfastening limit $P_{L2}$, where $P_{L2} \geq P_I$ and $P_{L2} \leq 0.95*|P_{L1}|$.

8. The method according to claim 7, wherein a relationship between the second unfastening limit $P_{L2}$ and the first unfastening limit $P_{L1}$ is: $P_{L2} \leq 0.85*|P_{L1}|$.

9. The method according to claim 1, wherein the operational parameter is constituted by either a power consumption of the motor or a current consumption of the motor.

10. The method according to claim 1, wherein the sub step of stopping the motor in the step of stopping the motor as soon as the real value P of the operational parameter exceeds the predetermined clogging limit $P_I$, where $P_I \geq 1.05*P_N$, includes that the control unit immediately after it is determined that the real value P of the operational parameter exceeded the clogging limit $P_I$ directly ceases the driving of the motor in said first direction by either disengaging the motor or setting an operational speed of the motor to zero.

* * * * *